US011404203B2

(12) United States Patent
Li et al.

(10) Patent No.: US 11,404,203 B2
(45) Date of Patent: Aug. 2, 2022

(54) MAGNETIC UNIT AND AN ASSOCIATED METHOD THEREOF

(71) Applicant: GENERAL ELECTRIC COMPANY, Schenectady, NY (US)

(72) Inventors: Cong Li, Schenectady, NY (US); Anoop Jassal, Schenectady, NY (US); Naveenan Thiagarajan, Niskayuna, NY (US); Satish Prabhakaran, Albany, NY (US); Kum-Kang Huh, Niskayuna, NY (US); Jiangbiao He, Niskayuna, NY (US); Xiaosong Kang, Dayton, OH (US); Ruxi Wang, Cohoes, NY (US)

(73) Assignee: General Electric Company, Schenectady, NY (US)

( * ) Notice: Subject to any disclaimer, the term of this patent is extended or adjusted under 35 U.S.C. 154(b) by 482 days.

(21) Appl. No.: 16/007,844

(22) Filed: Jun. 13, 2018

(65) Prior Publication Data

US 2019/0385785 A1 Dec. 19, 2019

(51) Int. Cl.
*H01F 27/34* (2006.01)
*H01F 27/24* (2006.01)
(Continued)

(52) U.S. Cl.
CPC ..... *H01F 27/34* (2013.01); *H01F 27/08* (2013.01); *H01F 27/24* (2013.01); *H01F 27/28* (2013.01)

(58) Field of Classification Search
CPC ..... H01F 27/34; H01F 27/24
See application file for complete search history.

(56) References Cited

U.S. PATENT DOCUMENTS 4,764,744 A * 8/1988 Alley ..... H01F 21/06 336/134
5,136,453 A * 8/1992 Oliver ..... G05F 3/04 361/111

(Continued)

FOREIGN PATENT DOCUMENTS

JP H0256414 U * 4/1990 ..... H01F 15/06

OTHER PUBLICATIONS

J. Fletcher et al. (hereinafter Fletcher) "Airgap Fringing Flux Reduction in Inductors Using Open-Circuit Copper Screens", IEE Proceedings—Electric Power Applications, vol. 152, Issue: 04, pp. 990-996, Jul. 2005 (Year: 2005).*

(Continued)

*Primary Examiner* — Elvin G Enad
*Assistant Examiner* — Malcolm Barnes
(74) *Attorney, Agent, or Firm* — McGarry Bair PC

(57) ABSTRACT

A magnetic unit is presented. The magnetic unit includes a magnetic core. The magnetic core includes a first limb and a second limb disposed proximate to the first limb, where a gap is formed between the first limb and the second limb. The magnetic unit further includes a first winding wound on the first limb. Moreover, the magnetic unit includes a conductive element disposed facing an outer periphery of the first winding, where the conductive element is configured to control a fringing flux generated at the gap. Further, the magnetic unit includes a heat sink operatively coupled to the conductive element, where the conductive element is further configured to transfer heat from at least one of the conductive element and the first winding to the heat sink. Moreover, a high frequency power conversion system and a method of operation of the magnetic unit is also presented.

20 Claims, 9 Drawing Sheets

(51) Int. Cl.
*H01F 27/08* (2006.01)
*H01F 27/28* (2006.01)

(56) References Cited

U.S. PATENT DOCUMENTS 5,414,401 A 5/1995 Roshen et al.
6,417,753 B1 7/2002 Wolf et al.
6,600,402 B1 * 7/2003 LaFleur ..... H01F 27/22 336/198
6,980,077 B1 12/2005 Chandrasekaran
7,295,092 B2 11/2007 Elliott et al.
7,427,910 B2 9/2008 Mehrotra et al.
7,808,359 B2 10/2010 Rao
7,830,236 B2 11/2010 Raiser et al.
2008/0079524 A1 * 4/2008 Suzuki ..... H01F 27/2804 336/61
2009/0146769 A1 * 6/2009 Feng ..... H01F 27/22 336/90
2010/0060404 A1 * 3/2010 Raiser ..... H01F 27/245 336/212
2017/0221625 A1 * 8/2017 Sullivan ..... H01F 3/14
2018/0233281 A1 * 8/2018 Yamaguchi ..... H01F 41/12
2019/0096571 A1 * 3/2019 Zhang ..... H01F 30/12
2019/0378643 A1 * 12/2019 Zhou ..... H01F 3/14

OTHER PUBLICATIONS

Fletcher et al., "Airgap Fringing Flux Reduction in Inductors Using Open-Circuit Copper Screens", IEE Proceedings—Electric Power Applications, vol. 152, Issue: 04, pp. 990-996, Jul. 2005.
Chen et al., "Improved Winding Loss Theoretical Calculation of Magnetic Component with Air-Gap", Power Electronics and Motion Control Conference (IPEMC), 2012 7th International, pp. 471-475, Jun. 2012.
Gerber et al. "A very high density, heatsink mounted inductor for automotive applications". Published in: Industry Applications Conference, 2002. 37th IAS Annual Meeting, pp. 948-954, Oct. 13-18, 2002.

* cited by examiner

MAGNETIC UNIT AND AN ASSOCIATED METHOD THEREOF

This invention was made with Government support under grant number DTFAWA-15-A-80013 awarded by the Government. The Government has certain rights in the invention.

BACKGROUND

Embodiments of the present specification generally relate to a magnetic unit and method of operation of the magnetic unit, and more particularly, to a gapped magnetic unit having reduced winding losses for high frequency power conversion applications.

As be appreciated, power conversion applications, such as, motor drives, backup electrical power supplies, and the like use magnetic units, such as inductors/transformers and pulse width modulated (PWM) inverters/conveners. The PWM inverters/converters typically generate high frequency switching signals. In order to attenuate the high frequency switching signals generated by the PWM inverter/converter, gapped magnetic units are employed instead of solid core magnetic units. The gapped magnetic unit includes a magnetic core having an air gap and copper wire windings wound on the magnetic core. The gapped magnetic units are prone to fringing flux at air gaps. The fringing flux at the air gap induces eddy currents in the copper wire windings. Accordingly, the copper wire windings are subjected to higher thermal losses.

In recent times, use of litz wire as windings instead of copper wires has been proposed. The litz wire reduces copper losses caused due to fringing flux. However, the litz wire has many insulation layers, which increases physical size of the wire itself. As a result, footprint of the magnetic core increases in order to accommodate the litz wire windings.

Also, recently, use of magnetic core having distributed air gaps have been proposed to reduce copper losses resulting due to fringing flux. However, cost of manufacture of the magnetic core having distributed air gaps is relatively high.

Therefore, there is a need for an enhanced gapped magnetic unit for reducing winding losses for high frequency power conversion applications.

BRIEF DESCRIPTION

In accordance with one aspect of the present specification, a magnetic unit is presented. The magnetic unit includes a magnetic core. The magnetic core includes a first limb and a second limb disposed proximate to the first limb, where a gap is formed between the first limb and the second limb. The magnetic unit further includes a first winding wound on the first limb. Moreover, the magnetic unit includes a conductive element disposed facing an outer periphery of the first winding, where the conductive element is configured to control a fringing flux generated at the gap. Further, the magnetic unit includes a heat sink operatively coupled to the conductive element, wherein the conductive element is further configured to transfer heat from at least one of the conductive element and the first winding to the heat sink.

In accordance with another aspect of the present specification, a high frequency power conversion system is presented. The high frequency power conversion system includes a converter. Further, the high frequency power conversion system includes a magnetic unit operatively coupled to the convener, where the magnetic unit includes a magnetic core. The magnetic core includes a first limb and a second limb disposed proximate to the first limb, where a gap is formed between the first limb and the second limb. Furthermore, the magnetic unit includes a first winding wound on the first limb. Moreover, the magnetic unit includes a conductive element disposed facing an outer periphery of the first winding, where the conductive element is configured to control a fringing flux generated at the gap. Further, the magnetic unit includes a heat sink operatively coupled to the conductive element, wherein the conductive element is further configured to transfer heat from at least one of the conductive element and the first winding to the heat sink.

In accordance with yet another aspect of the present specification, a method of operation of a magnetic unit is presented. The method includes generating a fringing flux at a gap formed between a first limb and a second limb. The method further includes inducing a current in a conductive element disposed dicing an outer periphery of the first winding, based on the fringing flux. Moreover, the method includes generating a cancelation flux at the gap based on the current in the conductive element to control the fringing flux. Further, the method includes transferring heat from at least one of the conductive element and the lint winding to a heat sink.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
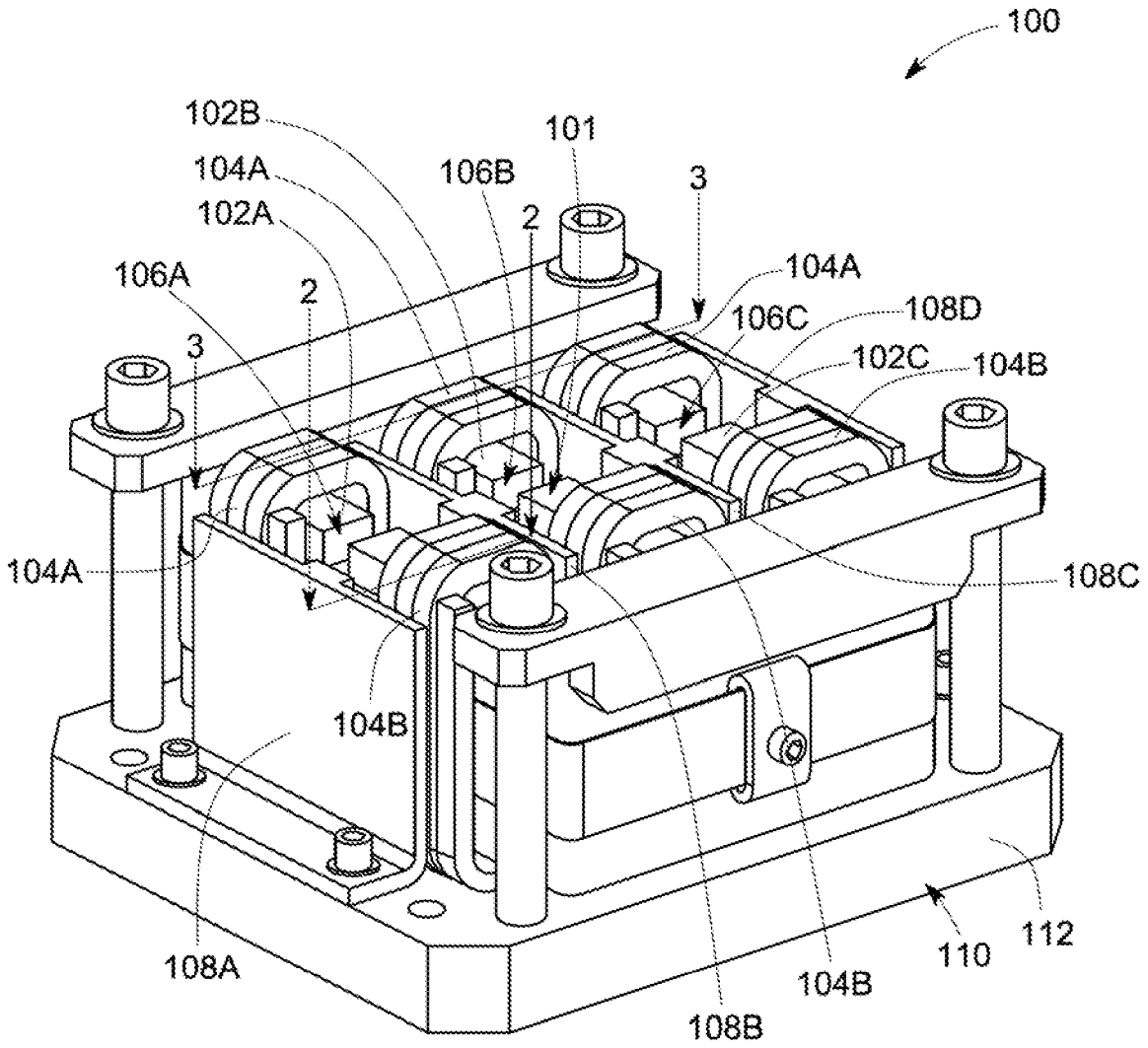
FIG. 1 is a perspective view of a magnetic unit according to aspects of the present specification.

Unless defined otherwise, technical and scientific terms used herein have the same meaning as is commonly understood by one of ordinary skill in the art to which this disclosure belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The use of "including," "comprising" or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect. The term "operatively coupled," as used herein, refers to direct and indirect coupling. Furthermore, the terms "circuit" and "circuitry" and "controller" may include either a single component or a plurality of components, which are either active and/or passive and are connected or otherwise coupled together to provide the described function.

As will be described in detail hereinafter, various embodiments of a magnetic unit, a power conversion system employing the magnetic unit, and a method for operation of the magnetic unit are disclosed. The exemplary magnetic unit may be employed in high frequency power conversion applications, such as locomotives, aircrafts, renewable power generation systems, hybrid electrical vehicles, and the like.

The magnetic unit may be an inductor or a transformer. The exemplary magnetic unit includes a magnetic core, a plurality of windings, and a conductive element. The magnetic core may be a gapped magnetic core or a solid magnetic core. The gapped magnetic core may have one or more gaps. The gaps of the gapped magnetic core may also be referred to as air gaps. The term 'air gap,' as used herein, refers to a non-magnetic region of the magnetic core. Use of the gapped magnetic core results in generation of a fringing flux in the gaps during operation of the magnetic unit. Further, a fringing flux may be generated between windings wound on limbs of the magnetic core, where the limbs are separated from each other by a gap. In particular, the limbs are placed a determined distance apart from each other. The term 'fringing flux,' as used herein, refers to a phenomenon in which a magnetic flux flowing in a magnetic core, spreads out (or fringes out) into a surrounding medium, for example, in and around the gap.

According to aspects of the present specification, the magnetic unit includes a conductive element. The conductive element is electrically and thermally conductive. The electrically conductive element allows flow of an electrical current in one or more directions. The thermally conductive element allows transfer of heat. The use of the conductive element aids in reducing copper losses due to fringing flux generated at the air gap of the magnetic core. Further, use of the conductive element aids in reducing copper losses due to the fringing flux generated between the windings wound on limbs of the magnetic core. Furthermore, use of the conductive element aids in transfer of heat to a heat sink thus providing an enhanced thermal management. The exemplary magnetic unit provides a low-cost and compact solution for reduction of copper losses due to the, fringing flux. The term 'copper losses,' as used herein, refers to heat produced by electrical current flowing in windings of transformers or other electrical devices/elements.

Turning now to the drawings, FIG. 1 is a perspective view of a magnetic unit 100 according to aspects of the present specification. The magnetic unit 100 is a three-phase magnetic unit. The magnetic unit 100 includes a magnetic core 101. The magnetic core 101 includes a first magnetic leg 102A, a second magnetic leg 102B, and a third magnetic leg 102C.

Each of the magnetic legs 102A, 102B, and 102C includes a first limb (not shown in FIG. 1) and a second limb (not shown in FIG. 1). A first winding 104A is wound on the first limb of each of the magnetic legs 102A, 102B, and 102C. Further, a second winding 104B is wound on the second limb of each of the magnetic legs 102A, 102B, and 102C. In one example, the first winding 104A may be a primary winding and the second winding 104B may be a secondary winding or vice versa. In the example of FIG. 1, the first and second windings 104A, 104B are split windings, since the first and second windings 104A, 104B are not coupled to each other and are wound on two different limbs of each of the magnetic legs 102A, 102B, 102C. Further, the first and second windings 104A, 104B are separated from each other.

In one embodiment, the first and second windings 104A, 104B are copper wires. In one embodiment, the first and second windings 104A, 104B have a rectangular cross-section. In another embodiment, the first and second windings 104A, 104B may have a circular cross-section, a square cross-section, and the like.

In one embodiment, a gap is formed between the first and second limbs of each of the magnetic legs 102A, 102B, and 102C. The gap formed between the first and second limbs of each of the magnetic legs 102A, 102B, and 102C is referred to as an air gap. The air gaps corresponding to the magnetic legs 102A, 1028, and 102C are represented by reference numerals 106A, 106B, and 106C respectively.

It may be noted that during operation of a conventional gapped magnetic unit, a fringing flux is generated at the air gap. In conventional gapped magnetic units, windings are disposed facing or proximate to the air gaps. Hence, the fringing flux tends to induce high magnitude eddy current in the windings. The high magnitude of the eddy current results in higher copper losses in the windings. The term 'eddy current,' as used herein, refers to a localized electrical current induced in a conductor by a varying magnetic field.

In accordance with aspects of the present specification, the first and second windings 104A, 104B are disposed at a determined distance from the corresponding air gaps 106A, 106B, 106C. In one embodiment, the determined distance may be about 4 mm to 5 mm. Additionally, the conductive elements 108A, 108B, 108C, and 108D are disposed facing an outer periphery (not shown in FIG. 1) of at least one of the first and second windings 104A, 104B. The conductive elements 108A, 108B, 108C, 108D are not disposed between an inner periphery (not shown in FIG. 1) of at least one the first and second windings 104A, 104B and the corresponding magnetic leas 102A, 102B, 102C.

In one embodiment, the conductive elements 108A, 108B, 108C, and 108D are disposed facing the air gaps 106A, 106B, and 106C. In one specific embodiment, the conductive elements 108A, 108B, 108C, and 108 D are disposed at a distance of about 1 millimeter (mm) from the corresponding air gaps 106A, 106B, and 106C. The distance of the conductive elements 108A, 108B, 108C, and 108D from the corresponding air gaps 106A, 106B, and 106C is determined based on a rating of the magnetic unit 100.

The conductive elements 108A, 108B, 108C, 108D are made of a non-magnetic material having a low permeability. In one embodiment, the conductive elements 108A, 108B, 108C, 108D may be made of aluminum, copper, and the like. Further, the conductive elements 108A, 108B, 108C, 108D may be in the form of a sheet or a wire loop. In one embodiment, the conductive elements 108A, 108B, 108C, 108D may have a non-uniform dimension. In another embodiment, the conductive elements 108A, 108B, 108C, 108D include slots.

A fringing flus is generated at the air gaps 106A, 106B, and 106C during operation of the magnetic unit 100. Further, in one embodiment, a fringing flux may be generated between the first windings 104A and/or the second windings 104B of the magnetic legs 102A, 102B, and 102C. As noted hereinabove, the first and second windings 104A, 104B are disposed at a predetermined distance away from each of the corresponding air gaps 106A, 106B, 106C. Hence, magnitude of the eddy current induced at the first and second windings 104A, 104B is lower compared to the conventional gapped magnetic unit where windings are disposed proximate to air gaps. Accordingly, the heat generated at the first and second windings 104A, 104B is relatively lower.

Furthermore, as noted hereinabove, the magnetic unit 100 includes the conductive elements 108A, 108B, 108C, 108D. The fringing flux generated at the air gaps 106A, 106B, and 106C induces eddy currents at the conductive elements 108A, 108B, 108C, 108D. In another embodiment, the fringing flux generated between the first windings 104A and/or the second windings 104B induces eddy currents at the conductive elements 108A, 108B, 108C, 108D. The eddy currents induced at the conductive elements 108A, 108B, 108C, 108D results in heating of the conductive elements 108A, 108B, 108C, 108D. Further, as a result of the eddy current induced at the conductive elements 108, 108B, 108C, 108D, a cancelation flux is generated at the corresponding air gaps 106A, 106B, 106C, respectively, according to Lenz's law. As will be appreciated, Lenz's law states that a current induced in a circuit due to a change in a magnetic field is directed to oppose the change in flux. The cancelation flux has a reverse polarity compared to a polarity of the fringing flux. Hence, at least a portion of the fringing flux is canceled and thereby, a magnitude of the fringing flux is reduced. In particular, the fringing flux is controlled. As a result, the magnitude of the eddy currents induced at least in the first and second windings 104A, 104B are reduced. Hence, the heat generated at the first and second windings 104A, 104B is reduced.

In accordance with aspects of the present specification, the magnetic unit 100 further includes a heat sink 110. A combination of the heat sink 110 and the conductive elements 108A, 108B, 108C and 108D may be referred to as a thermal management device. In one embodiment, the conductive elements 108A, 108B, 108C, 108D function as fins of the heat sink 110. The term 'heat sink,' as used herein, refers to a heat exchanger that transfers heat generated by an electronic, an electrical, or a mechanical device to a fluid medium, such as air or a liquid coolant, where heat is dissipated away from the device, thereby allowing regulation of the temperature of the device.

According to aspects of the present specification, the heat sink 110 includes heat pipes (not shown in FIG. 1) and a heat dissipation base 112. In accordance with aspects of the present specification, the conductive elements 108A, 108B, 108C, 108D are operatively coupled to the heat sink 110 and specifically, to the heat dissipation base 112. The conductive elements 108A, 108B, 108C, 108D are used to transfer the generated heat to the heat sink 110. In one embodiment, the heat generated at the first and second windings 104A, 104B is transferred to the conductive elements 108A, 108B, 108C, 108D via thermal interface material including grease, epoxy, pad, other potting compounds, air, and the like. In another embodiment, heat generated at the first and second windings 104A, 104B is also transferred by convection and/or radiation to the conductive elements 108A, 108B, 108C, 108D. Subsequently, the conductive elements 108A, 108B, 108C, 108D transfers the heat to the heat sink 110 by conduction. Therefore, the conductive elements 108A, 108B, 108C, 108D contribute towards dissipation of heat in addition to reducing copper losses in the windings 104A, 104B due to the fringing flux generated at the air gaps 106A, 106B, and 106C. As a result, the temperature of the magnetic units is maintained at an optimal value.

Although the example of FIG. 1 depicts a three-phase magnetic unit use of a single phase magnetic unit having a magnetic core having a single magnetic leg is also envisioned. In another embodiment, use of multi-phase magnetic units is envisioned. Also, although FIG. 1 depicts densely packed windings on each limb of a magnetic leg, use of sparsely packed windings on each limb of the magnetic leg is envisaged.

Although example of FIG. 1 depicts each limb having a corresponding winding, in certain embodiments, limbs devoid of windings are envisaged. Furthermore, although in the example of FIG. 1 magnetic core includes three first limbs and three second limbs, in other embodiments, the number of limbs may vary. In one embodiment, a magnetic core may include three first limbs and one second limb.

Figure 2:
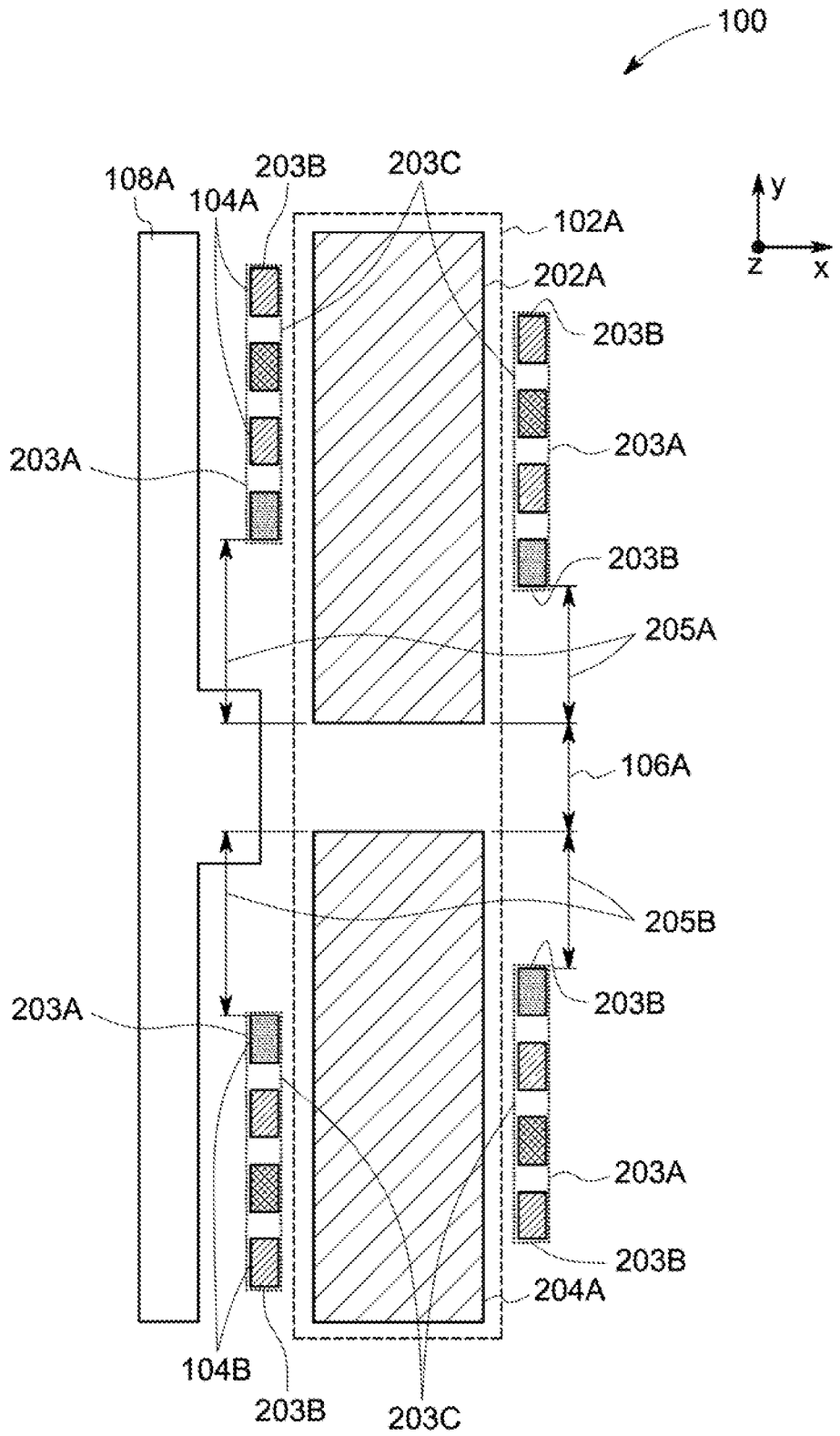
FIG. 2 is a cross-sectional representation of a portion of a magnetic unit of FIG. 1 according to aspects of the present specification.

Referring now to FIG. 2, a cross-sectional representation of a portion of a magnetic unit 100, according to aspects of the present specification is shown. In particular, FIG. 2 is a cross-sectional view along the line 2-2 of FIG. 1. More particularly, FIG. 2 represents specifically a cross-section of a single magnetic leg 102A of the magnetic unit 100. The magnetic leg 102A includes a first limb 202A and a second limb 204A. The first limb 202A is disposed proximate to the second limb 204A such that the air gap 106A is formed between the first and second limbs 202A, 204A. In the example of FIG. 2, the first limb 202A is aligned with the second limb 204A, The phrase 'first limb 202A aligned with the second limb 204A' refers to alignment of a central axis of the first limb 202A with a central axis of the second limb 204A. The term 'central axis of the first limb 202A' refers to an axis passing through a center of gravity of the first limb 202A along a y-axis direction. In a similar manner, the term 'central axis of the second limb 204A' refers to an axis passing through a center of gravity of the second limb 204A along the y-axis direction.

Further, the first limb 202A and the second limb 204A are made of magnetic materials having relatively high magnetic permeability. In one embodiment, the first limb 202A and the second limb 204A are made of materials such as ferrite. Moreover, multiple turns, of the winding 104A are wound on the first limb 202A and multiple turns of the winding 104B are wound on the second limb 204A. Number of turns of the first and second windings 104A and 104B on the first and second limbs 202A, 204A respectively may vary depending on the application.

The windings 104A, 104B has outer peripheries 203A, 203B and an inner periphery 203C. The inner periphery 203C of the windings 104A 104B is disposed facing the first limb 202A and the second limb 204A of the magnetic leg 102A.

As previously noted, during operation of the magnetic unit 100, the fringing flux is generated at the air gap 106A. In conventional gapped magnetic units, fringing flux tends to induce eddy currents in windings. The eddy current results in high copper losses in the winding.

In accordance with aspects of the present specification, the first winding 104A is disposed at a determined distance 205A from the air gap 106A. Also, the second winding 104B is disposed at a determined distance 205B from the air gap 106A. In one embodiment, the determined distances 205A and 205B may range from about 4 mm to about 5 mm. The fringing flux at the air gap 106A induces eddy currents of lower magnitude in the first winding 104A compared to the conventional gapped magnetic unit where the windings are disposed directly facing the air gap. Hence, the copper losses in the first and second windings 104A, 104B are reduced. In one embodiment, the determined distances 205A, 205B are in the millimeter range.

Further, the exemplary magnetic unit 100 includes the conductive element 108A. The conductive element 108A is disposed facing the outer periphery 203A of the first and second windings 104A, 104B. In addition, the conductive element 108A is disposed facing the air gap 106A.

As noted hereinabove, the fringing flux is generated at the air gap 106A. As a result, the eddy current is induced at the conductive element 108A. The eddy current induced at the conductive element 108A heats up the conductive element 108A. As a result of the eddy current induced at the conductive element 108A, the cancelation flux is induced at the air gap 106A according to Lenz's law. Hence, at least a portion of the fringing flux is canceled and thereby, the magnitude of the fringing flux is reduced. As a result, the magnitude of the eddy currents induced in the first and second windings 104A and 104B is reduced. It may be noted that eddy currents in the first and second windings 104A, 104B results in copper losses in the first and second windings 104A, 104B. Accordingly, the first and second windings 104A, 104B are heated. In one embodiment, heat generated at the first and second windings 104A, 104B is transferred via thermal interface material (not shown in FIG. 2) including grease, epoxy, pad, other potting compounds, air, and the like to the conductive element 108A. The conductive element 108A is configured to transfer heat to the heat sink by conduction. The structure of the heat sink will be described in greater detail below with respect to FIG. 7.

Figure 3:
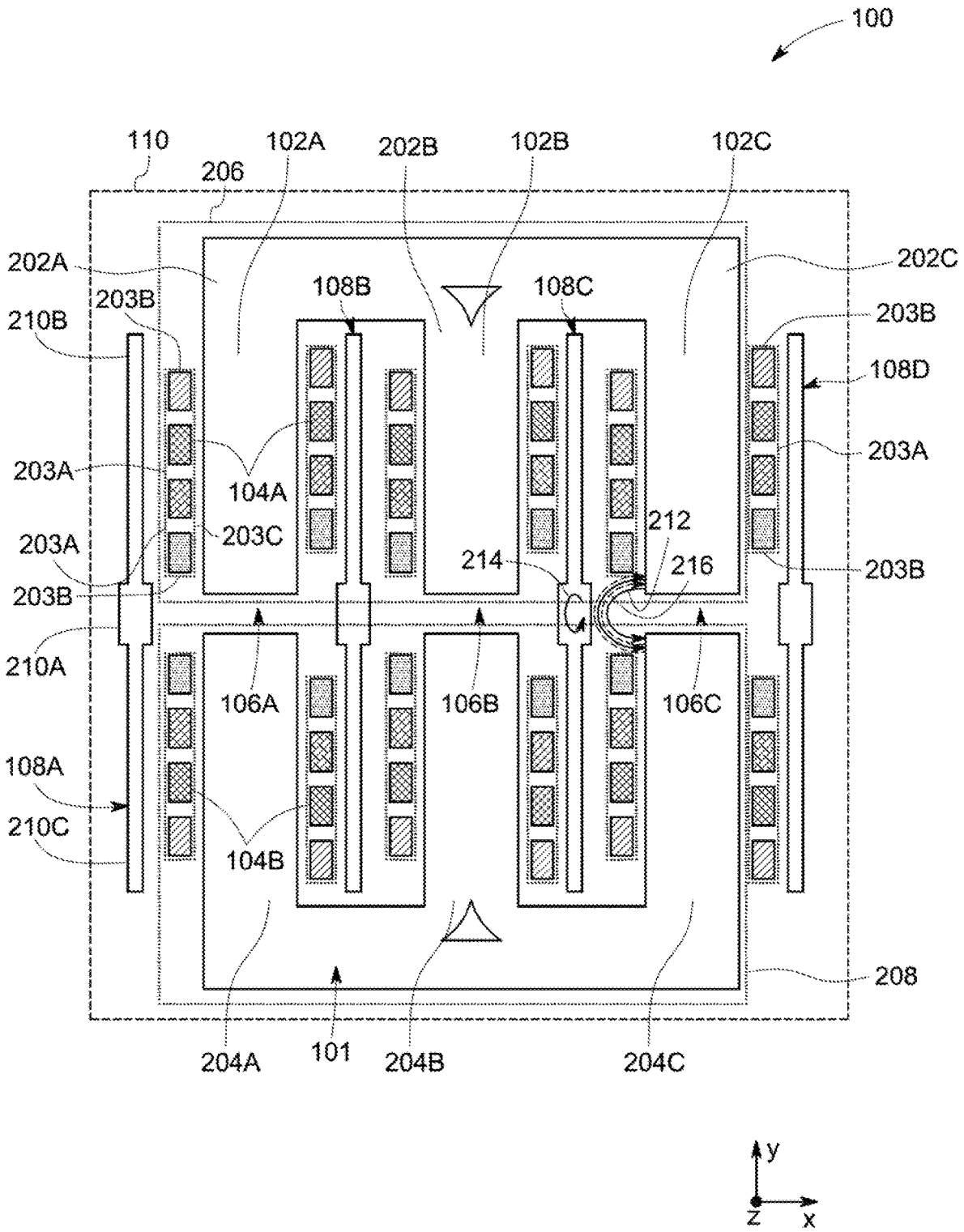
FIGS. 3-5 are cross-sectional representations of different embodiments of a magnetic unit according to aspects of the present specification.

FIG. 3 is a cross-sectional representation of one embodiment of the magnetic unit 100 of FIG. 1 according to aspects of the present specification. In particular, FIG. 3 is a cross-sectional view along the line 3-3 of FIG. 1. The magnetic unit 100 includes the magnetic core 101. The magnetic core 101 includes three magnetic legs 102A, 102B, 102C. The magnetic leg 102A includes the first limb 202A and the second limb 204A. Similarly the magnetic leg 102B includes a first limb 202B and a second limb 204B and the magnetic leg 102C includes a first limb 202C and a second limb 204C. The first limbs 202A, 202B, and 202C form a first E-shaped sub-core 206. Further, the second limbs 204A, 204B, and 204C form a second E-shaped sub-core 208. In the illustrated embodiment of FIG. 2, the first E-shaped sub-core 206 is aligned with the second E-shaped sub-core 208. In particular, each of the first limbs 202A, 202B, and 202C is aligned with corresponding second limbs 204A, 204B, and 204C. The first E-shaped sub-core 206 and the second E-shaped sub-core 208 together form a "E-E" shaped magnetic core 101 of the magnetic unit 100.

The first air gap 106A is formed between the first limb 202A and the second limb 204A. Similarly, the second air gap 106B is formed between the first limb 202B and the second limb 204B and the third air gap 106C is formed between the first limb 202C and the second limb 204C. Multiple turns of the first winding 104A may be wound on each of the first limbs 202A, 202B, 202C and multiple turns of the second winding 104B may be wound on each of the second limbs 204A, 204B, 204C.

In the illustrated embodiment of FIG. 3, the conductive elements 108A and 108D are disposed at outer regions of the first and second E-shaped sub-cores 206, 208. More particularly, the conductive element 108A is disposed facing a portion of the outer periphery 203A of the first and second windings 104A, 104B wound on the leg 102A. Further, the conductive element 108D is disposed facing a portion of the outer periphery 203A of the first and second windings 104A, 104B wound on the leg 102C. The conductive element 108B is disposed between the magnetic legs 102A and 102B. Specifically, the conductive element 108B is disposed facing a portion of the outer periphery 203A of the first and second windings 104A, 104B wound on the legs 102A, 102B. Further, the conductive element 108C is disposed between the magnetic legs 102B and 102C. Specifically, the conductive element 108C is disposed facing a portion of the outer periphery 203A of the first and second windings 104A, 104B wound on the legs 102B, 102C. Furthermore, at least a portion of the conductive elements 108A, 108B, 108C, and 108D are disposed facing the corresponding air gaps 106A, 106B, and 106C.

Further, the dimension of the conductive elements 108A, 108B, 108C, 108D along z-axis similar to the dimension of the magnetic legs 102A, 102B, 102C along the z-axis. The term 'dimension,' as used herein, may be used to refer to length, breadth/thickness, or height of the magnetic leg or the conductive element. In one embodiment, each of the conductive elements 108A, 108B, 108C, 108D has a first portion 210A and two second portions 210B, 210C. The first portion 210A is formed between the two second portions 210B, 210C. The first portion 210A is disposed directly facing the air gap 106A. The second portions 210B, 210C are disposed at a determined distance from the air gap 106A.

Furthermore, each of the conductive elements 108A, 108B, 108C, 108D has a non-uniform dimension along x-axis. In particular, the dimension of the first portion 210A along x-axis is about 2 mm. Further, the dimension of the second portions 210B, 210C along the x-axis is about 1 mm. The thickness of the first portion 210A of the conductive elements 108A, 108B, 108C, 108D facilitates enhanced heat dissipation. In another embodiment, the conductive elements 108A, 108B, 108C, 108D have a uniform dimension. In such an embodiment, the dimension of each of the conductive elements 108A, 108B, 108C, 108D along the x-axis is about 2 mm.

In one embodiment, the conductive elements 108A, 108B, 108C, 108D surround the air gaps 106A, 106B, or 106C. In such an embodiment, the conductive elements 108A, 108B, 108C, 108D are three-dimensional structures. In particular, each of the conductive elements 108A, 108B, 108C, 108D have a plurality of sections extending along different planes. In a specific embodiment, each of the conductive elements 108A, 108B, 108C, 108D includes at least three sections disposed surrounding the corresponding air gap. In one embodiment, each of the conductive elements 108A, 108B, 108C, 108D include first and second sections extending along the y-z plane and a third section extending along the x-y plane. In another embodiment, each of the conductive elements 108A, 108B, 108C, 108D includes only one section extending along the x-y plane.

During; operation of the magnetic unit 100, a fringing flux 212 is generated at the air gaps 106A, 106B, 106C. In the illustrated embodiment of FIG. 3, the fringing; flux 212 generated only at the air gap 106C is depicted for ease of representation. The fringing flux 212 induces an eddy current 214 in the corresponding conductive element 108C. The eddy current 214 induced only at the conductive element 108C is depicted for ease of representation. The eddy current 214 induces a cancelation flux 216 according to Lenz's law. The cancelation flux 216 has a reverse polarity compared to the fringing flux 212. In one example, at least a portion of the fringing flux 212 is canceled. Accordingly, the fringing flux 212 may be controlled/reduced. Hence, magnitude of the eddy currents induced in the first and second windings 104A, 104B is reduced. Further, the first and second windings 104A, 104B are disposed at a determined distance from the corresponding air gap 106C. Hence, the eddy currents induced at the first and second windings 104A, 104B are reduced. Thus, copper losses in the first and second windings 104A, 104B are reduced. Thereby, the heat generated in the first and second windings 104A, 104B is reduced. Similarly, cancelation flux is generated at other air gaps.

Additionally, the magnetic unit 100 includes a heat sink 110. The conductive elements 108A, 108B, 108C, 108D are coupled to the heat sink 110. As noted hereinabove, the heat sink 110 includes a heat pipe and a heat dissipation base. The conductive elements 108A, 108B, 108C, 108D are used to transfer generated heat to the heat sink 110. In addition, heat generated at the first and second windings 104A, 104B is transferred via thermal interface material (not shown in FIG. 3) including grease, epoxy, pad, other potting compounds, air, and the like to the conductive elements 108A, 108B, 108C, 108D and subsequently, transferred to the heat sink 110. Although the example of FIG. 3 depicts the magnetic unit 100 having E-shaped sub-cores, the magnetic unit 100 having different sub-core shapes is envisaged.

Figure 4:
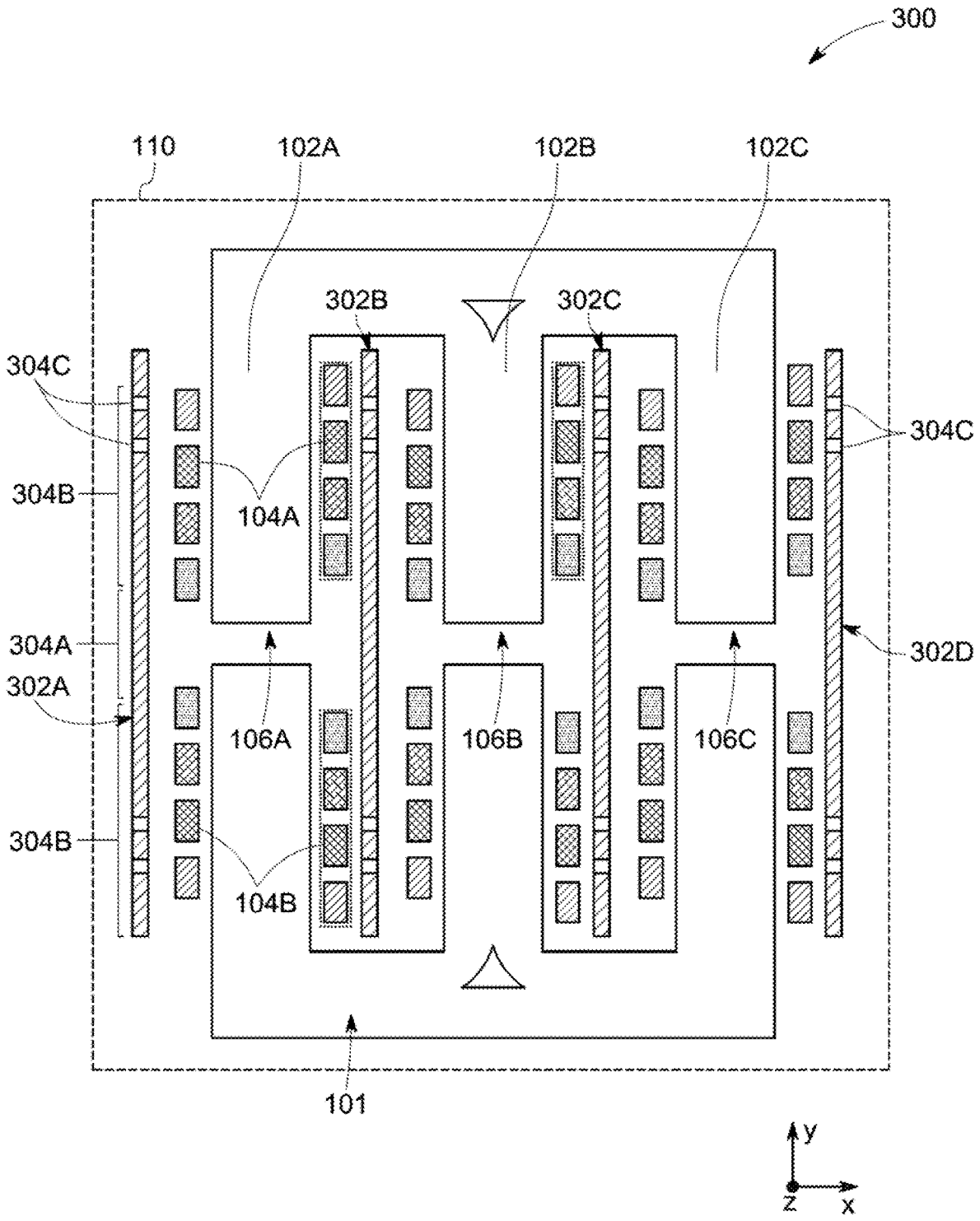
Figure 5:
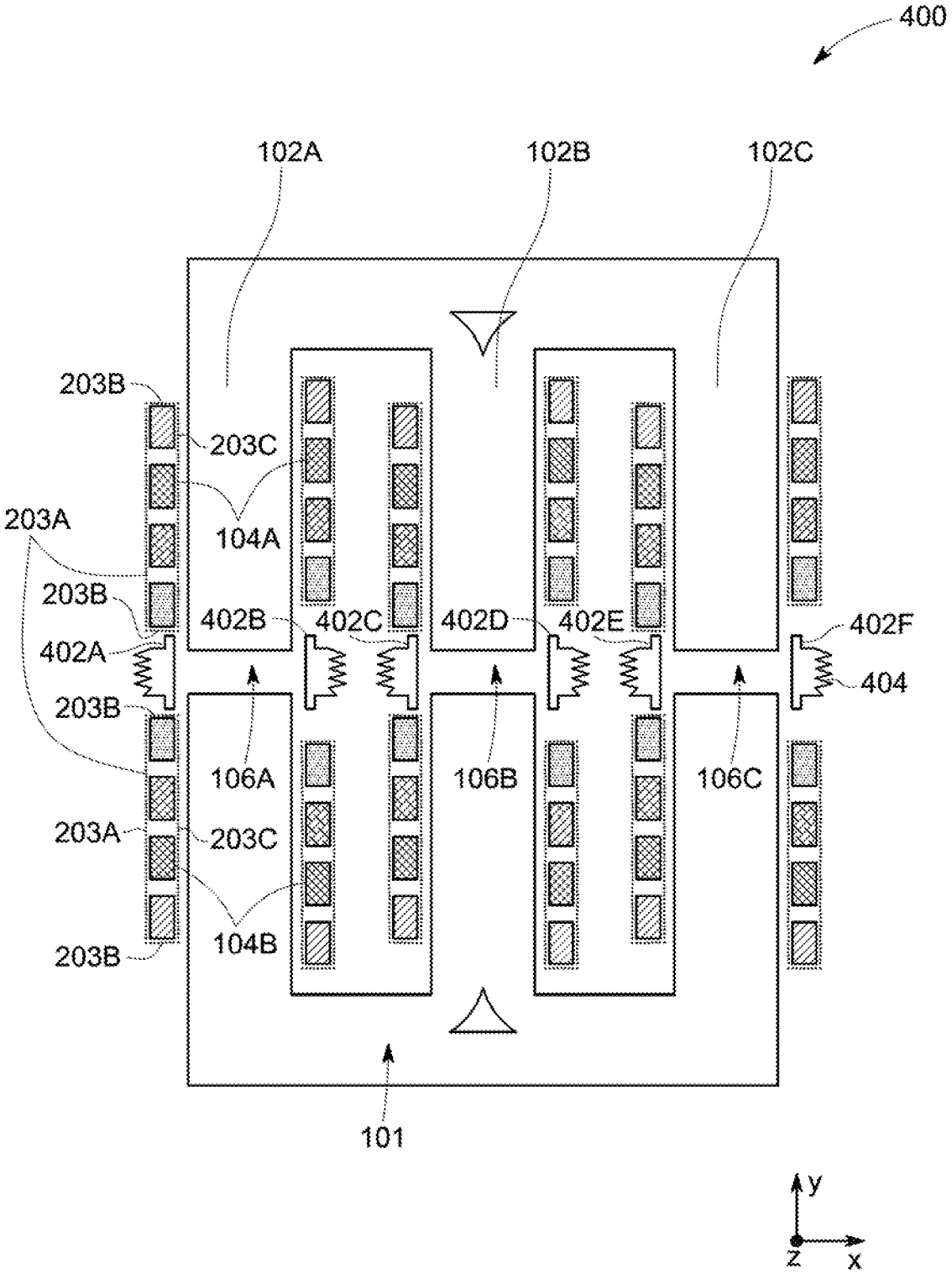

FIGS. 4-5 are cross-sectional representations of different embodiments of a magnetic unit 100 of FIG. 1, according to aspects of the present specification. In particular, FIG. 4 represents cross-section of one embodiment of a magnetic unit 300. The magnetic unit 300 is a three-phase magnetic unit. The magnetic unit 300 includes the magnetic core 101. The magnetic core 101 includes three magnetic legs 102A, 102B, 102C. Each magnetic lea 102A, 102B, 102C has the first limb and the second limb and the air gap formed between the first limb and the second limb. The air gaps are represented by reference numerals 106A, 106B, 106C.

According to aspects of the present specification, the magnetic unit 300 includes conductive elements 302A, 302B, 302C, and 302D. The conductive elements 302A, 302B, 302C, and 302D are disposed facing the outer periphery (not shown in FIG. 4) of the first and second windings 104A, 104B. Additionally, at least a portion of the conductive elements 302A, 302B, 302C, and 302D are disposed facing the air gaps 106A, 106B, and 106C. Each of the conductive elements 302A, 302B, 302C, 302D are in form of a sheet. In the embodiment of FIG. 4, each of the conductive elements 302A, 302B, 302C, 302D includes a first region 304A sandwiched between two second regions 304B. The second regions 304B include a plurality of slots 304C. The first region 304A is disposed directly facing the corresponding air gaps 106A, 106B, and 106C. Further, the second regions 304B are disposed at a determined distance from the air gaps 106A, 106B, and 106C. In one embodiment, the thickness of the each of the conductive elements 302A, 302B, 302C, 302D along the x-axis is about 2 mm. Further, dimension of the conductive elements 302A, 302B, 302C, 302D along z-axis may be similar to the dimension of the magnetic legs 102A, 102B, 102C along the z-axis. The term 'dimension,' as used herein, may be used to refer to length, breadth/thickness, or height of the magnetic leg or the conductive element. The exemplary conductive elements 302A, 302B, 302C, 302D are lighter compared to the conductive elements 108A, 108B, 108C, and 108D of FIG. 1 due to presence of the slots 304C.

During operation of the magnetic unit 300, the fringing flux is generated at the first, second, and third air gaps 106A, 106B, 106C. The fringing flux induces eddy currents in the conductive elements 302A, 302B, 302C, 302D. The eddy currents induce the cancelation flux according to Lenz's law. The cancelation flux has a reverse polarity compared to the fringing flux. In one example, at least some of the fringing flux is canceled. Accordingly, the fringing flux is controlled reduced. Hence, magnitude of the eddy currents induced in the first and second windings 104A, 104B is reduced. Further, the first and second windings 104A, 104B are disposed at a determined distance from the corresponding air gaps 106A, 106B, 106C. Thus, copper losses in the first and second windings 104A, 104B is reduced.

Additionally, the magnetic, unit 300 is disposed on the heat sink 110. The conductive elements 302A, 302B, 302C, 302D are coupled to the heat sink 110. The conductive elements 302A, 302B, 302C, 302D are used to transfer heat to the heat sink 110. In addition, heat generated at the first and second windings 104A, 104B is transferred via thermal interface material (not shown in FIG. 4) including grease, epoxy, pad, other potting compounds, air, and the like to the conductive elements 302A, 302B, 302C, 302D and subsequently, transferred to the heat sink 110. Thus, temperature of the magnetic unit 300 is maintained at an optimal value.

Referring now to FIG. 5, a cross-section of one embodiment of a magnetic unit 100 of FIG. 1 is shown. A magnetic unit 400 includes the magnetic core 101. The magnetic core 101 includes three magnetic legs 102A, 102B, 102C. Each magnetic leg 102A, 102B, 102C has the first limb and the second limb. Further, the air gap is formed between the first limb and the second limb. The air gaps are represented by reference numerals 106A, 106B, 106C.

The magnetic unit 400 includes conductive elements 402A, 402B, 402C, 402D, 402E, 402F. The conductive elements 402A, 402B, 402C, 402D, 402E, 402F are disposed facing the outer periphery of at least one of the first and second windings 104A, 104B. In particular, the conductive elements 402A, 402B, 402C, 402D, 402E, 402F are disposed facing the outer peripheries 203B of the first and second windings 104A, 104B. More particularly, the conductive elements 402A, 402B are sandwiched between the corresponding outer peripheries 203B of the first and second windings 104A, 104B of the first leg 102A. In a similar manner, the conductive elements 402C, 402D are sandwiched between the corresponding outer peripheries 203B of the first and second windings 104A, 104B of the second leg 102B. Further, the conductive elements 402E, 402F are sandwiched between the corresponding outer peripheries 203B of the first and second windings 104A, 104B of the third leg 102C.

Additionally, at least a portion of the conductive elements 402A, 402B, 402C, 402D, 402E, 402F are disposed facing the air gaps 106A, 106B, and 106C. In one embodiment, the conductive elements 402A, 402B, 402C, 402D, 402E, 402F are wires or sheets formed as a loop. The conductive element 402A is disposed on one side of the air gap 106A and the conductive element 402B is disposed on an opposite side of the air gap 106A. Further, the conductive element 402C is disposed on one side of the air gap 106B and the conductive element 402C is disposed on an opposite side of the air gap 106B. Furthermore, the conductive element 402E is disposed on one side of the air gap 106C and the conductive element 402F is disposed on an opposite side of the air gap 106C.

As noted hereinabove, during operation of the magnetic unit 400, the fringing flux is generated at the air gaps 106A, 106B, 106C. The fringing flux induces eddy currents in the conductive elements 402A, 402B, 402C, 402D, 402E, 402F. The eddy currents in the conductive elements 402A, 402B, 402C, 402D, 402E, 402F heats the conductive elements 402A, 402B, 402C, 402D, 402E, 402F. Further, the eddy currents in the conductive elements 402A, 402B, 402C, 402D, 402E, 402F induce cancelation flux at the corresponding air gaps 106A, 106B, 106C. The cancelation flux at the air gaps 106A, 106B, 106C reduces the fringing flux. As, a result, magnitude of the eddy currents induced in the first and second windings 104A, 104B is reduced. Furthermore, the first and second windings 104A, 104B are disposed at a determined distance from the corresponding air gaps 106A, 106B, 106C. Thus, copper losses of the first and second windings 104A, 104B are reduced.

In the, embodiment of FIG. 5, a resistor 404 is coupled to each of the conductive elements 402A, 402B, 402C, 402D, 402E, 402F. In one embodiment, the resistor 404 may be disposed at a predetermined distance from each of the conductive elements 402A, 402B, 402C, 402D, 402E, 402F. Eddy currents flowing through the conductive elements 402A, 402B, 402C, 402D, 402E, 402F dissipates heat at the corresponding resistor 404.

Further, the magnetic unit 400 includes the heat sink (not shown). The conductive elements 402A, 402B, 402C, 402D, 402E, 402F are coupled to the heat sink. The conductive elements 402A, 402B, 402C, 402D, 402E, 402F are used to transfer heat to the beat sink, either directly or through the corresponding resistors 404. In addition, heat generated at the windings 104A, 104B is transferred via thermal interface material (not shown in FIG. 5) including grease, epoxy, pad, other potting compounds, air, and the like to the corresponding conductive elements 402A, 402B, 402C, 402D, 402E, 402F and subsequently transferred to the heat sink.

Although the example of FIG. 5 depicts two conductive elements disposed facing each air gap, in other embodiments, the number of conductive elements disposed facing each air gap may vary depending on application.

Figure 6:
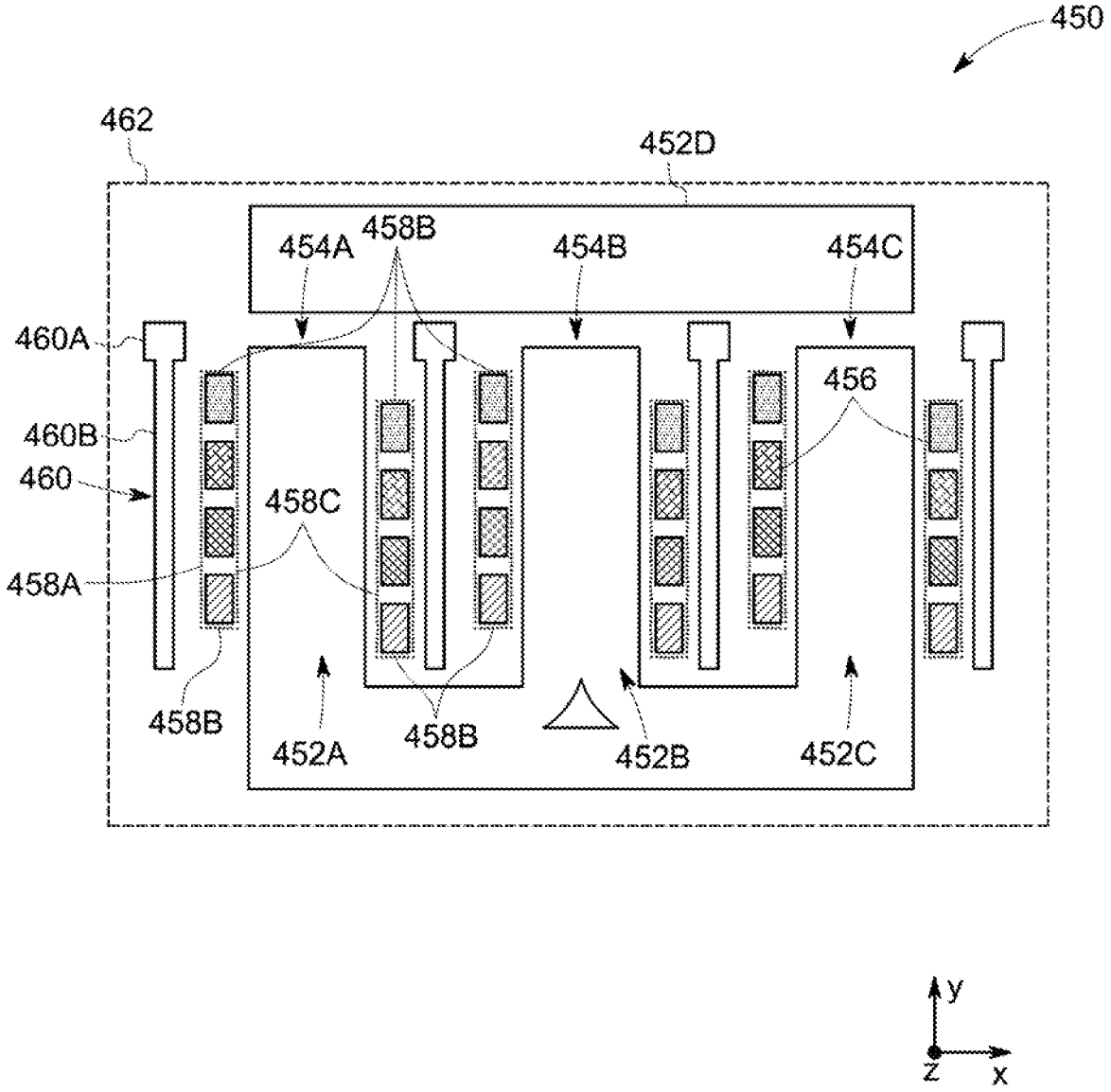
FIG. 6 is across-sectional representation of one embodiment of a magnetic unit according to aspects of the present specification.

FIG. 6 is a cross-sectional representation of a magnetic unit 450 according to aspects of the present specification. The magnetic unit 450 includes three first limbs 452A, 452B, 452C and a second limb 452D. The first limbs 452A, 452B, 452C form a E-shaped sub-core and the second limb 452D forms a I-shaped sub-core. The first limbs 452A, 452B, 452C and the second limb 452D together form an "E-I" shaped magnetic core.

Further, a gap 454A is formed between a first portion of the second limb 452D and the first limb 452A. Further, a gap 454B is formed between a second portion of the second limb 452D and the first limb 452B. Moreover, a gap 454C is formed between at third portion of the second limb 452D and the first limb 452C. The gaps 454A, 454B, 454C may be referred to as air gaps.

In the illustrated embodiment of FIG. 6, a winding 456 is wound on each of the first limbs 452A 452B, 452C. The winding 456 includes outer peripheries 458A and 458B and an inner periphery 458C. The inner periphery 458C directly faces the corresponding first limbs 452A, 452B, 452C.

Furthermore, the exemplary magnetic unit 450 includes a plurality of conductive elements 460. Each conductive element 460 is disposed lacing the outer periphery 458A of the corresponding winding 456. Further, each conductive element 460 includes a first portion 460A and a second portion 460B. The first portion 460A is thicker compared to the second portion 460B. In one embodiment, the first portion 460A has a dimension of 2 mm along the x-axis and the second portion 460B has a dimension of 1 mm along x-axis. The term 'dimension,' as used herein, may be used to refer to length, breadth/thickness, or height of the first or second portions of the conductive element. Each first portion 460A is disposed directly lacing the corresponding air gaps 454A, 454B, 454C.

During operation of the magnetic unit 450, a fringing flux is generated at the air gaps 454A, 454B, 454C. The fringing flux induces eddy currents in the corresponding conductive elements 460. The eddy currents in the conductive elements 460 heats the conductive elements 460. Further, the eddy currents in the conductive elements 460 induces cancelation flux at the corresponding air gaps 454A, 454B, 454C. The cancelation flux at the air gaps 454A, 454B, 454C in turn reduces the fringing flux. As a result, magnitude of the eddy currents induced in the windings 456 is reduced. Thus, copper losses of the windings 456 are reduced.

Further, the magnetic unit 450 includes a heat sink 462. The conductive elements 460 are coupled to the heat sink 462. The conductive elements 460 are used to transfer heat of the conductive elements 460 to the heat sink 462. In addition, heat generated at the windings 456 is transferred via thermal interface material (not shown in FIG. 6) including grease, epoxy, pad, other potting compounds, air, and the like to the corresponding conductive elements 460 and subsequently transferred to the heat sink 462.

Figure 7:
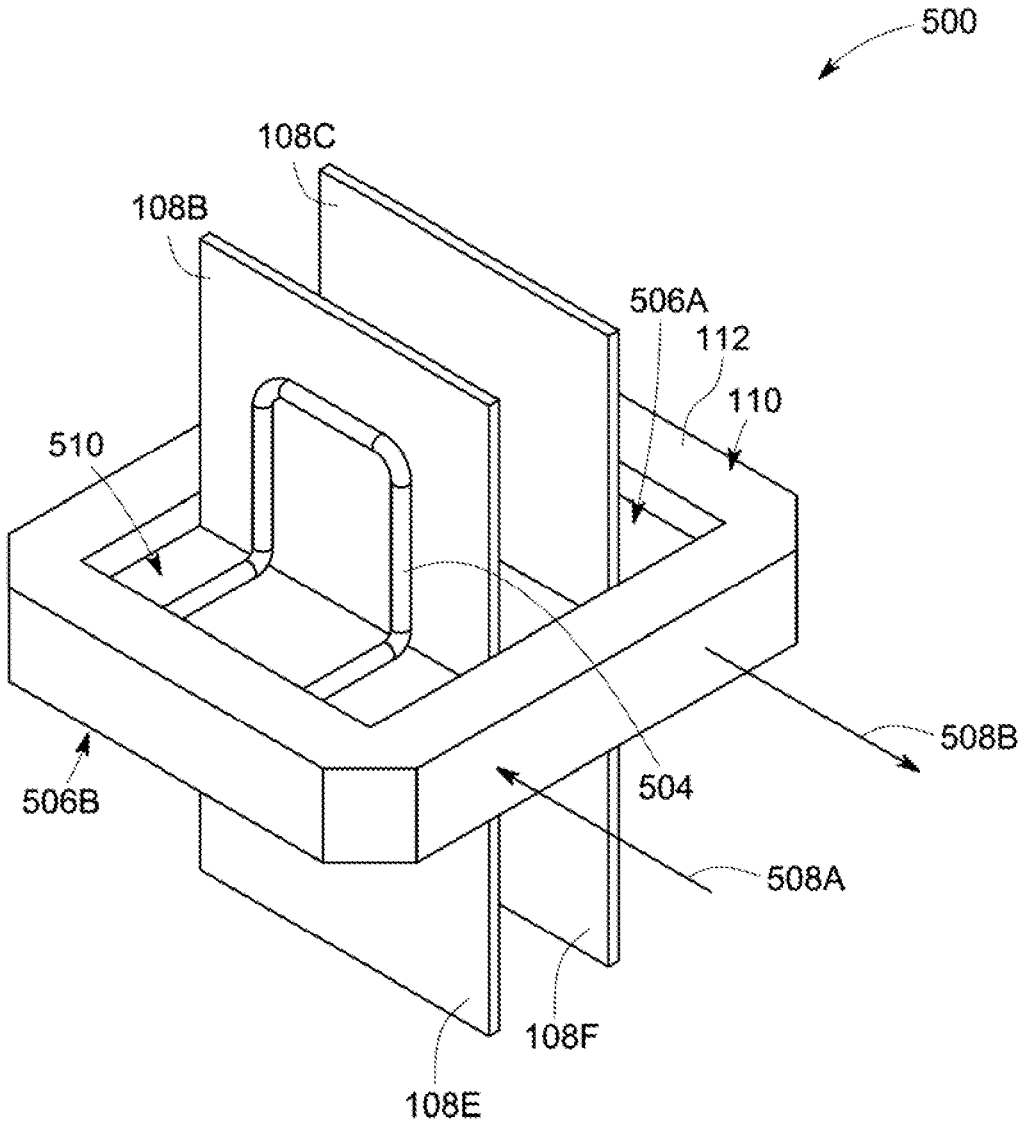
FIG. 7 is a perspective view of a thermal management device of the magnetic unit of FIG. 1 according to aspects of the present specification.

FIG. 7 is a perspective view of a thermal management device 500 of the magnetic unit of FIG. 1, according to aspects of the present specification. In particular, FIG. 7 represents a portion of the magnetic unit 100 of FIG. 1. The thermal management device 500 includes a combination of the heat sink 110 and the conductive elements 108B, 108C and heat dissipation elements 108E, 108F.

The heat sink 110 includes a heat dissipation base 112 and a beat pipe 504. The heat dissipation base 112 has a first surface 506A and an opposite second surface 506B. The conductive elements 108B and 108C are disposed on the first surface 506A of the beat dissipation base 112 and heat dissipation elements 108E and 108F are disposed on the second surface 506B of the heat dissipation base 112. In one embodiment, the heat dissipation elements 108E and 108F are thermally conductive elements. In another embodiment, the heat dissipation elements 108E and 108F are electrically conductive in addition to being thermally conductive. In one embodiment, the second surface 506B may be subjected to forced/natural convection using air/liquid as media. In another embodiment, the second surface 506B may be conductively coupled to another beat sink.

In yet another embodiment, the heat dissipation base 112 includes internal channels 510, where the internal channels 510 are configured to allow flow of a coolant. A direction of flow of the coolant into the heat dissipation base 112 is represented using a reference numeral 508A. Further, a direction flow of the coolant from the heat dissipation base 112 is represented using a reference numeral 508B. The coolant may be any fluid media, such as, but not limited to air and water. The internal channels 510 of the heat dissipation base 112 aid in enhanced heat dissipation. In yet another embodiment, the internal channels 510 of the heat dissipation base 112 includes surf ice area enhancing design features such as fins, studs, ribs to enhance surface area for heat dissipation.

In one embodiment, the conductive elements 108B, 108C and the heat dissipation elements 108E, 108F may include surface area enhancing features such as studs, pin fins, ribs, and the like for heat dissipation. In one embodiment, the heat pipe 504 may be disposed on at least one of the heat dissipation base 112, the conductive elements 108B, 108C, and the heat dissipation elements 108E, 108F. In the example of FIG. 7, the heat pipe 504 is embedded in the heat dissipation base 112 and the conductive elements 108B, 108C. In one embodiment, a heat pipe may be embedded in the heat dissipation elements 108E, 108F. The use of the heat pipe 504 on the conductive elements 108B, 108C and the heat dissipation elements 108E, 108F aids in enhanced thermal conductivity. In one embodiment, the heat pipe 504 may be copper pipe having water, an aluminum pipe having acetone, or the like.

In one embodiment, the conductive elements 108B, 108C and the heat sink 110 are separate elements. In such embodiments, the conductive elements 108B, 108C may be coupled to the heat sink 110 using adhesives, threaded fasteners, bolts, welding, brazing, and the like.

In another embodiment, the thermal management device 500 having the conductive elements 108B, 108C and the heat sink 110 is a monolithic structure. As used herein, the term "monolithic structure" refers to a continuous structure that is substantially free of any joints. In one example, the monolithic structure may be a unitary structure devoid of any joined parts or layers. In some embodiments, the monolithic thermal management device 500 may be formed as one structure during processing, without any brazing or multiple sintering steps. In a specific embodiment, the thermal management device 500 is a monolithic 3D vapor chamber.

Although the example of FIG. 7, depicts only two conductive elements, in other embodiments, the number of conductive elements may vary based on the application. Also, although the example of FIG. 7 depicts the heat pipe being disposed only on one conductive element, in another embodiment, the heat pipe may be disposed on all the conductive elements in another embodiment.

Figure 8:
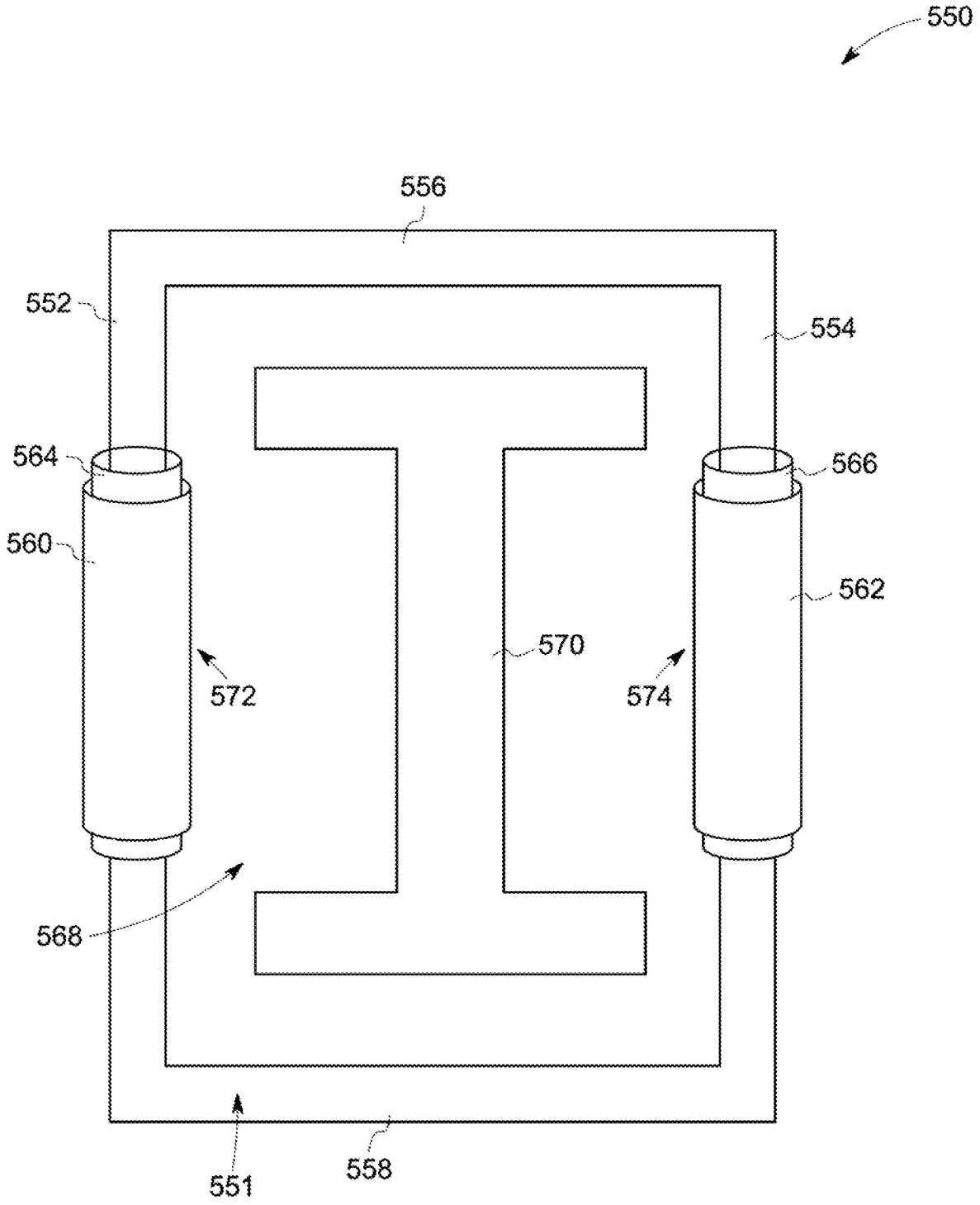
FIG. 8 is a cross-sectional representation of another embodiment of a magnetic unit according to aspects of the present specification.

FIG. 8 is a cross-sectional representation of another embodiment of a magnetic unit 550 according to aspects of the present specification. The magnetic unit 550 includes a magnetic core 551 having a first limb 552, a second limb 554, and branches 556, 558. One end of the first limb 552 is coupled to one end of the second limb 554 via the branch 556. Further, other end of the first limb 552 is coupled to other end of the second limb 554 via the branch 558.

Further, a first winding 560 is wound around the first limb 552. Further, a second winding 562 is wound on the second limb 554. Furthermore, a third winding 564 is wound on the first limb 552 and a fourth winding 566 is wound on the second limb 554. The third winding 564 is sandwiched between the first winding 560 and the first limb 552. The fourth winding 566 is sandwiched between the second winding 562 and the second limb 554. The third and fourth windings 564, 566 form primary windings of the magnetic unit 550. The first and second windings 560, 562 form secondary windings of the magnetic unit 550.

A gap 568 is formed between the first limb 552 and the second limb 554. A fringing flux is generated between the windings 560, 564 wound on the first limb 552 and the windings 562, 566 wound on the second limb 554. In one embodiment, the fringing flux is generated between the first winding 560 and the second winding 562.

In accordance with aspects of the present specification, a conductive element 570 similar to the conductive elements 108A, 108B, 108C, or 108D of FIG. 1, is disposed within the gap 568. In particular, at least a portion of the conductive element 570 is disposed facing at least a portion of an outer periphery 572 of the first winding 560 and at least a portion of an outer periphery 574 of the second winding 562. The use of the conductive element 570 aids in controlling reducing the fringing flux generated between the windings 560, 564, 562, 566 wound on the first and second limbs 552, 554.

In one embodiment, the conductive element 570 may be coupled to a heat sink (not shown in FIG. 8) similar to the heat sink 110 of FIG. 1. Further, the conductive element 570 is configured to dissipate heat generated at at least one of the conductive element 570 and the windings 560 562, 564, 566 to the heat sink.

Figure 9:
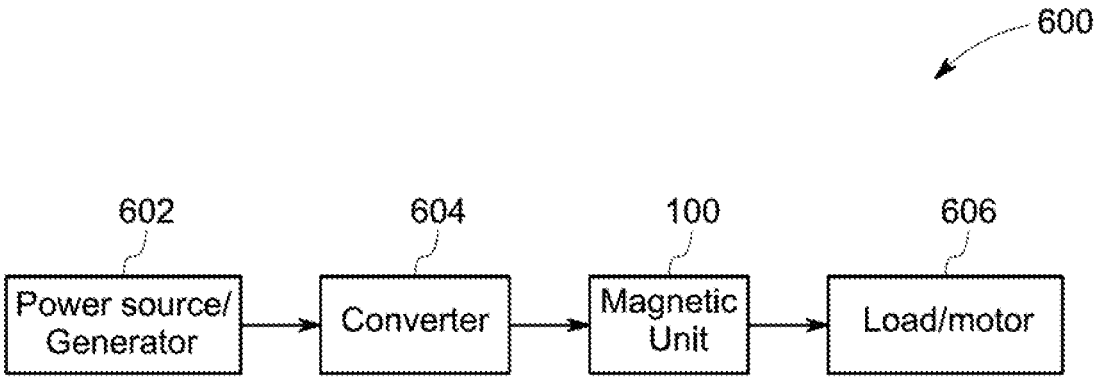
FIG. 9 is a block diagram of a power conversion system using the magnetic unit of FIG. 1 according to aspects of the present specification.

FIG. 9 is a block diagram of a power conversion system 600 having the magnetic unit 100 of FIG. 1, according to aspects of the present specification. The power conversion system 600 includes a power source/generator 602, a converter 604, the magnetic unit 100, and a load 606. The power source/generator 602 is coupled to the converter 604. Further, the converter 604 is coupled to the magnetic unit 100 which in turn is coupled to the load 606.

The power source/generator 602 may be an alternating current (AC) power source, a direct current (DC) power source, or the like. In one embodiment, the power source/generator 602 may be a solar panel, a wind turbine, or the like. The converter 604 may be a AC to AC power converter, a DC to AC convener, or the like. The term 'converter' as used herein, refers to an electrical or electro-mechanical device used for converting electrical energy from one form to another.

The magnetic unit 100 is an inductor, a transformer, or the like. The exemplary magnetic unit 100 has a magnetic core having a gap defined therein. Further, in one embodiment, the magnetic unit 100 includes conductive elements disposed facing the gap. In another embodiment, the conductive elements are disposed within the gap. The conductive elements are used to reduce heating of the windings due to the fringing flux and transfer heat generated at the conductive elements and the windings to the heat sink.

During operation of the power conversion system 600, in one embodiment, an input voltage is provided to the convener 604 from the power source/generator 602. The input voltage is converted by the convener 604 to an output voltage having a determined frequency and magnitude. The output voltage is further transmitted to the magnetic unit 100. In one embodiment, the magnetic unit 100 is configured to step up the input voltage and generate a stepped-up voltage. The stepped-up voltage is further provided to the load 606. In one embodiment, the load 606 includes a motor. The exemplary power conversion system 600 may be used in an aircraft electrical system, a locomotive electrical, system, a renewable power system, and the like.

Figure 10:
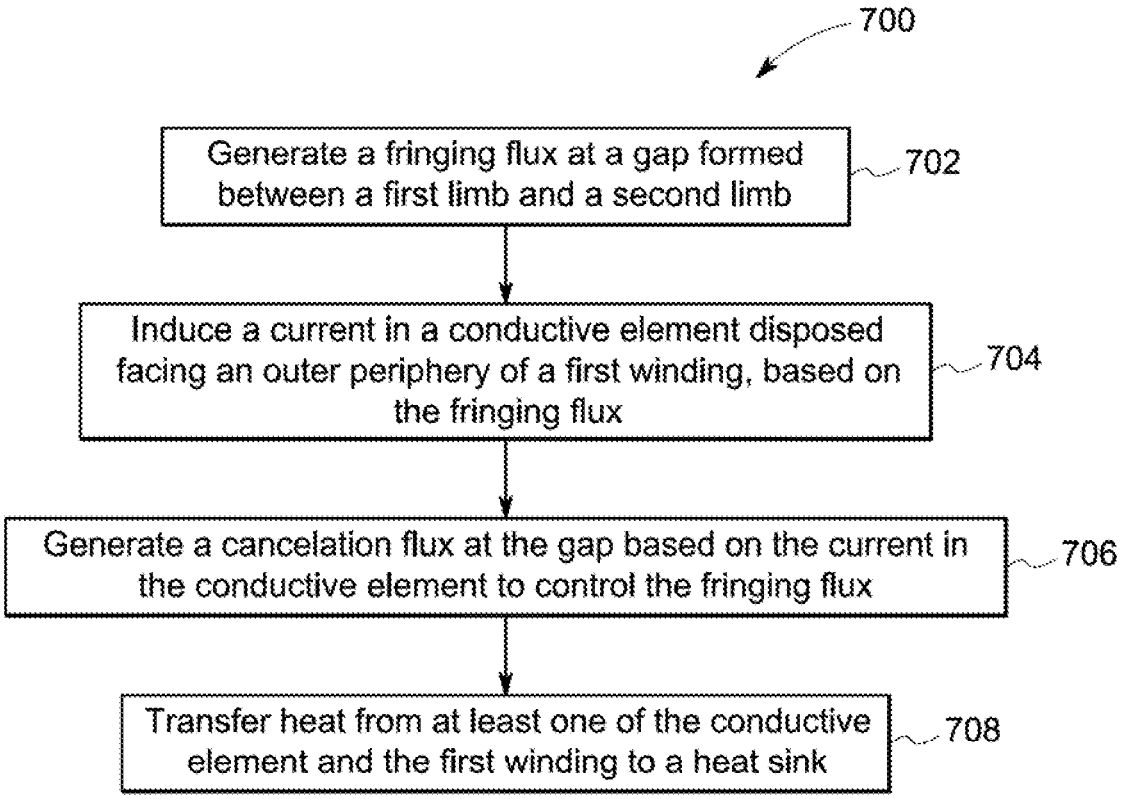
FIG. 10 is a flow chart representing a method for operation of the magnetic unit of FIG. 1 according to aspects of the present specification.

FIG. 10 is a flow chart 700 representing a method for operation of the magnetic unit of FIG. 1 according to aspects of the present specification. At step 702, fringing flux is generated at the air gap formed between the first limb and the second limb of the magnetic leg during operation of the magnetic unit. In particular, the fringing flux is generated at the air gap due to electrical energization of the magnetic unit. More particularly, the fringing flux is generated at the air gap due to a current provided to the magnetic unit. In another embodiment, a fringing flux may be generated between the windings wound on the first limb and the second limb during operation of the magnetic unit.

Further, at step 704, a current is induced at the conductive element disposed facing the outer periphery of the windings. The current is induced at the conductive element based on the fringing flux in accordance with Lenz's law. The current induced at the conductive element may also be referred to as the eddy current.

Furthermore, at step 706, the cancelation flux is induced at the gap between the first limb and the second limb based on the eddy current induced in the conductive element. In another embodiment, the cancelation flux is induced at the gap between windings wound on the first limb and the second limb based on the eddy current induced in the conductive element. The cancelation flux has a reverse polarity compared to the fringing flux. As a result, at least a portion of the fringing flux is canceled. As a result, magnitude of the eddy currents induced in the windings is reduced. Thereby, the copper losses in the windings are reduced.

Additionally, at step 708, heat from at least one of the conductive element and the first winding is transferred to a heat sink. In one embodiment, heat generated at the first and second windings is transferred to the heat sink. In particular, the heat generated at the first and second windings is transferred via thermal interface material including grease, epoxy, pad, other potting compounds, air, and the like to the conductive element and subsequently, to the heat sink by conduction.

In accordance with the embodiments discussed herein, an exemplary magnetic unit having a magnetic core, a plurality of windings, and a conductive element is disclosed. The magnetic unit has a magnetic core having one or more gaps defined therein. Further, the exemplary magnetic unit has conductive elements which aids in reducing winding copper losses due to the fringing flux. Further, the conductive element in combination with the heat sink of the magnetic unit aids in enhanced heat dissipation. Accordingly, the temperature of the magnetic unit is reduced considerably.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

The invention claimed is:

1. A magnetic unit comprising:
- a magnetic core comprising:
  - a first limb; and
  - a second limb disposed proximate to the first limb, wherein a gap is formed between the first limb and the second limb;
- a first winding wound on the first limb;
- a second winding wound on the second limb;
- a conductive element disposed facing the gap and an outer periphery of the first winding, wherein the conductive element is thermally conductive and electrically conductive in order to control a fringing flux generated at the gap; and
- a heat sink operatively coupled to the conductive element, wherein the conductive element is configured to transfer heat from at least one of the conductive element and the first winding to the heat sink, wherein the heat sink is a heat dissipation base.

2. The magnetic unit of claim 1, wherein the magnetic unit is a transformer, an inductor, or a combination thereof.

3. The magnetic unit of claim 1, further comprising a second winding wound on the second limb.

4. The magnetic unit of claim 3, wherein the conductive element is disposed between the outer periphery of the first winding and an outer periphery of the second winding.

5. The magnetic unit of claim 4, wherein the conductive element is configured to control a fringing flux generated between the first winding and the second winding.

6. The magnetic unit of claim 4, wherein at least part of the conductive element is disposed within the gap.

7. The magnetic unit of claim 3, wherein at least one of the first and second windings is disposed between the conductive element and the first and second limbs.

8. The magnetic unit of claim 1, further comprising a heat pipe disposed on the conductive element.

9. The magnetic unit of claim 1, wherein the heat sink comprises an internal channel to allow flow of a coolant.

10. The magnetic unit of claim 1, wherein the conductive element is a sheet.

11. The magnetic unit of claim 10, wherein the conductive element comprises a first portion and a second portion, wherein the first portion is thicker than the second portion.

12. The magnetic unit of claim 11, wherein the first portion faces the gap.

13. The magnetic unit of claim 10, wherein the conductive element comprises a first region and a second region, wherein the second region comprises a plurality of slots.

14. The magnetic unit of claim 1, wherein the conductive element comprises a wire loop, wherein the wire loop is disposed facing the gap.

15. The magnetic unit of claim 1, wherein the conductive element comprises at least two sections in y-z plane and a section in x-y plane, wherein the at least two sections in y-z plane are coupled to the section in x-y plane to surround at least the gap.

16. The magnetic unit of claim 1, wherein the conductive element is a non-magnetic metal.

17. The magnetic unit of claim 16, wherein the conductive element is an aluminum wire, an aluminum sheet, or a combination thereof.

18. A high frequency power conversion system comprising:
- a converter,
- a magnetic unit operatively coupled to the converter, wherein the magnetic unit comprises:
  - a magnetic core comprising at least a first magnetic leg and a second magnetic leg, each of the first and second magnetic legs comprising:
    - a first limb; and
    - a second limb disposed proximate to the first limb, wherein a gap is formed between the first limb and the second limb; and
  - a first winding wound on the first limb;
- a conductive element disposed between the first magnetic leg and the second magnetic leg, the conductive element facing the gap and an outer periphery of each of the first windings, wherein the conductive element is thermally conductive and electrically conductive in order to control a fringing flux generated at each of the gaps; and
- a heat sink operatively coupled to the conductive element, wherein the conductive element is further configured to transfer heat from at least one of the conductive element and the first winding to the heat sink, wherein the heat sink is a heat dissipation base.

19. A method of operation of a magnetic unit, the method comprising:
- generating a fringing flux at a gap formed between a first limb and a second limb, the first limb having a first winding wound on the first limb, and the second limb having a second winding wound on the second limb;
- inducing a current in a conductive element disposed facing the gap and an outer periphery of the first winding, based on the fringing flux, the conductive element being thermally conductive and electrically conductive;
- generating a cancelation flux at the gap based on the current in the conductive element to control the fringing flux; and
- transferring heat from at least one of the conductive element and the first winding to a heat sink, wherein the heat sink is a heat dissipation base.

20. The magnetic unit of claim 1, wherein the first limb is aligned with the second limb.

* * * * *